United States Patent [19]

Chlystun

[11] 4,027,811

[45] June 7, 1977

[54] BLOW MOLDED CONTAINER WITH NESTABLE POURING SPOUT WITH IMPROVED SPOUT OPENING AND WITHDRAWAL MEANS

[76] Inventor: Walter K. Chlystun, 327 St. James Drive, Spartanburg, S.C. 29304

[22] Filed: Dec. 8, 1975

[21] Appl. No.: 638,618

[52] U.S. Cl. ..... 222/529

[51] Int. Cl.[2] ..... B67D 3/00

[58] Field of Search ..... 222/527, 529, 535, 484, 222/541, 543, 188

[56] References Cited

UNITED STATES PATENTS

| | | | |
|---|---|---|---|
| 3,298,577 | 1/1967 | Chlystun | 222/529 |
| 3,690,522 | 10/1970 | Chlystun | 222/529 |

*Primary Examiner*—Stanley H. Tollberg
*Assistant Examiner*—Norman L. Stack, Jr.
*Attorney, Agent, or Firm*—Wellington M. Manning, Jr.

[57] ABSTRACT

A container is disclosed having a collapsible pouring spout in the top portion thereof. The pouring spout is nestable within the container in a preferred arrangement, and the container walls, container top and pouring spout are of integral or unitary construction having been blow molded. The pouring spout in the nested position within the container is more easily withdrawn if a vent is provided. The vent may be opened at the time it is desirable to initially withdraw the spout for dispensing from the container. Where the spout has a removable cover secured thereto in unitary fashion with a weakened tear line therearound, and the cover has a handle means thereon for withdrawal of the spout and removal of the cover, the present invention adds a further feature of a V or similar shaped undercut adjacent the weakened tear line between the cover and the pouring spout. Upon lifting of the cover handle, the V shaped undercut section opens first and accomplishes a double result. A vent is produced for the pouring spout for easy withdrawal from the container body, and secondly, the undercut section is the beginning of the tear line for removal of the cover whereby the cover can be pulled from the container spout by further lifting of the handle.

14 Claims, 8 Drawing Figures

BLOW MOLDED CONTAINER WITH NESTABLE POURING SPOUT WITH IMPROVED SPOUT OPENING AND WITHDRAWAL MEANS

BACKGROUND OF THE INVENTION

Containers with integral pouring spouts have been developed heretofore as evidenced by the Chlystun U.S. Pat. Nos. 3,690,522 and 3,856,187, directed to same. Likewise, other containers have been proivded where pouring spouts are reversible so as to be disposed inside the container, collapse into the container in some fashion, screw onto the container or the like. In general, with the advent of blow molding and with further refinements of tool making capabilities, a container having a pouring spout may be produced such that the spout can be everted to a nestable position within the container. Opposite ends of the container are then coplanar with respect to the edges and permit ease of stacking, handling and the like. Furthermore, it is quite desirable in such containers that the pouring spout be withdrawable to a pouring position and that a cover or tip is removeable therefrom to permit convenient dispensing of the contents of the container without the need for separate spouts or the like.

According to the prior art, including that supplied by Walter K. Chlystun, a recloseable or resealable feature has also been provided so that the cover that is removed from the spout, once the spout is withdrawn, is replaceable over the spout to reclose or reseal the container. Hence where all of the contents of the container are not dispensed in a single use, the cover can be replaced over the spout to a snap-fit, threaded or similar arrangement to reclose or reseal the container depending upon the requirements therefor.

Containers such as mentioned above, are primarily intended for use for storing and dispensing oil, hazardous chemicals, fuels and various household and industrial compositions. An independent opener and/or spout is no longer required to such use and containers according to the types following the teachings of the present invention are quite suitable for sale through vending machines at self-service gasoline stations, or other locations with the containers having motor oil or other petroleum products therein that might be found in these location outlets. In addition to the advantages supplied by the lack of a need of an opener, pouring spout or the like, containers according to the present invention have been found to be more durable, quickly filled on existing packaging equipment, and less likely to leak or be reptured during normal handling and use. The old problem of "leakers", a hazard to outlets for motor oil and the like has been, for the most part, obviated. Containers according to the present invention may now be placed on a store shelf where they can remain for a long period of time without any real danger of leakage of the contents from the container.

The present invention thus provides a further improved dispensing container where a vent is produced by normal withdrawal of the pouring spout and where further, depending upon the structure of the spout with respect to the cover, the vent may initiate rupture of a weakened tear line to separate the cover from the pouring spout. The prior art does not teach or suggest the inventive concept of the present invention. Exemplary of the prior art are U.S. Pat. Nos 2,533,305 to Wells; 2,685,385 to Kuss; 2,895,654 to Rieke; 3,042,271 to Winstead; 3,298,577 to Chlystun; 3,326,421 to Peace; 3,481,515 to Booth et al; 3,502,246 to Kelbch, and 3,690,522 to Chlystun.

SUMMARY OF THE INVENTION

It is an object of the present invention to provide an improved container with a collapsible pouring spout.

Another object of the present invention is to provide an improved container having a collapsible pouring spout where novel vent means are provided to aid ease of withdrawal of the spout from a nested position when the container is full and sealed.

Still another object of the present invention is to provide an improved blow molded container having a pouring spout produced integral therewith and a self producing vent means thereon.

Yet another object of the present invention is to provide an improved blow molded container with a recloseable or resealable collapsible pouring spout having improved opening means therefor.

Generally speaking, the container of the present invention comprises a container body; a top secured to said body; a pouring spout secured to said top and being nestable within said container body; a cover secured to said pouring spout, said cover having spout withdrawal means therewith; a weakened tear area located adjacent the juncture between said cover and said spout and permitting said cover to be removed from said spout; and a second weakened tear area located on said spout and being secured to an underside of said spout withdrawal means, said second weakened tear area being rupturable upon withdrawal of said spout so as to produce a vent thereat and permit continued easy withdrawal of said spout from its nested position.

More specifically, the container of the present invention in a preferred embodiment has a nestable spout that is integral with the container body and top, said spout being in a nested position when the container is full and withdrawable to a pouring position. During withdrawal of the spout, it is preferred, and perhaps necessary to provide a vent to ensure proper withdrawal of the spout. A cover provided atop the pouring spout is separatable therefrom along a first weakened tear area which permits removal of the cover from the spout in easy fashion. Adjacent the weakened tear area, a second tear area is provided that preferably extends longitudinally along the dispensing spout and is secured to an underside of the spout withdrawal means which commonly is a tab or the like. Initial lifting of the tab or withdrawal means causes the second weakened tear area to rupture longitudinally along the spout, whereby a vent is produced in a forward end of the spout. Continued pulling of the tab will thereafter cause the first weakened tear area to also rupture to facilitate removal of the cover from the end of the spout. Rupture of the first tear area occurs during or after withdrawal of the spout from its nested position so as to then permit dispensing of the contents of th container through the spout.

In certain embodiments of the present invention, the cover may simply be removeable from the dispensing spout without and recloseable or resealable features therewith. Alternatively, however, the cover as will be described hereinafter may simply be replaceable on the pouring spout so as to reclose same or may be receivable on the spout in a sealing engagement to reseal the container. The first and second weakened tear area may be independent of each other or may be connected such that upon termination of tearing at the second tear area, tearing proceeds along the juncture between the cover and the spout at the first weakened tear area and thereafter permits dispensing of the contents from within the container. In a most preferred form, the second weakened tear area is provided beneath a V shaped segment of plastic that connects a portion of the side wall of the pouring spout to the underside of the withdrawal means that are included with the cover. An undercut produced during the molding operation likewise in a V shape, permits the lower pointed undercut edge to rupture, after which the area continues to rupture along the V until complete or until the first weakened tear area begins to rupture for removal if the cover from the spout. The vent producing means may terminate on said spout as desired, however, and may not extend longitudinally along the spout for any appreciable distance. Instead, a spot type vent opening may be produced in the spout as well as one that extends circumferentially around a portion of the spout. Likewise, other vent arrangements are possible.

In a most preferred embodiment, the container of the present invention is integral insofar as the container body, container top, spout, cover and withdrawal means are concerned, in that, the preferred method of manufacture is by a blow molding technique. Blow molding is well known to those skilled in the art where a pliable plastic material in parison form is clamped in between mold parts around a blow pin, or a blow needle is injected therethrough. An expansion fluid is then expeled into the inside of the parison and expands the parison into conformity with the mold cavities to produce the container.

DESCRIPTION OF THE PREFERRED EMBODIMENTS

Figure 1:
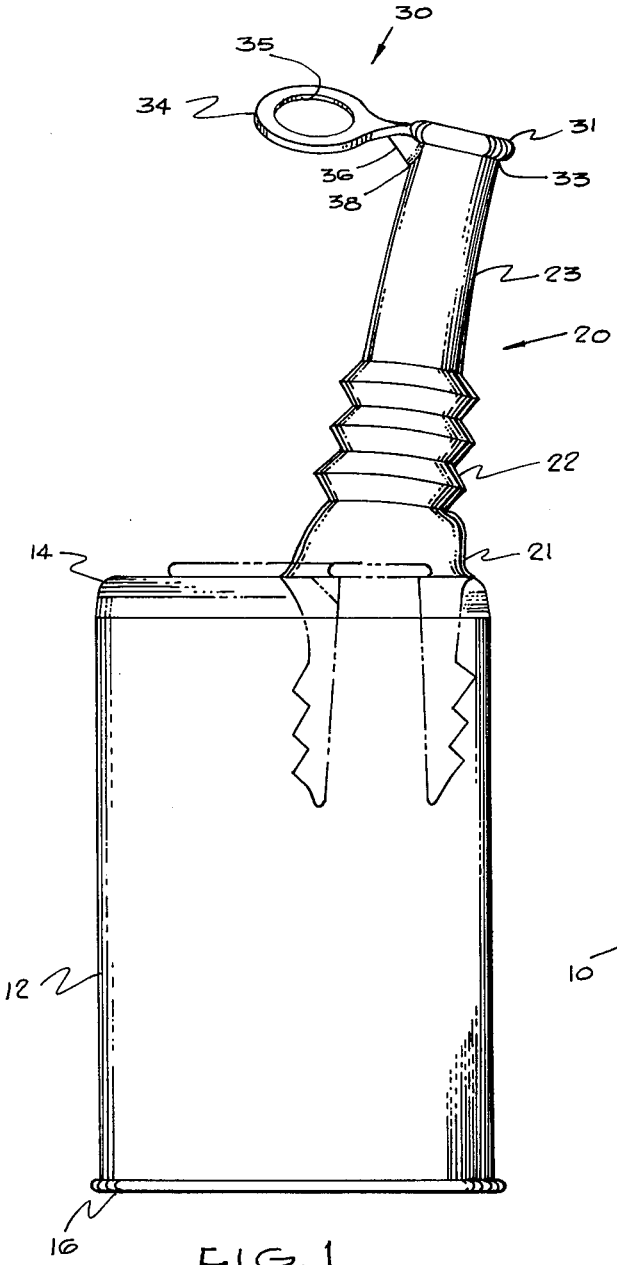
FIG. 1 is a side elevational view of a container according to the teachings of the present invention.
Figure 2:
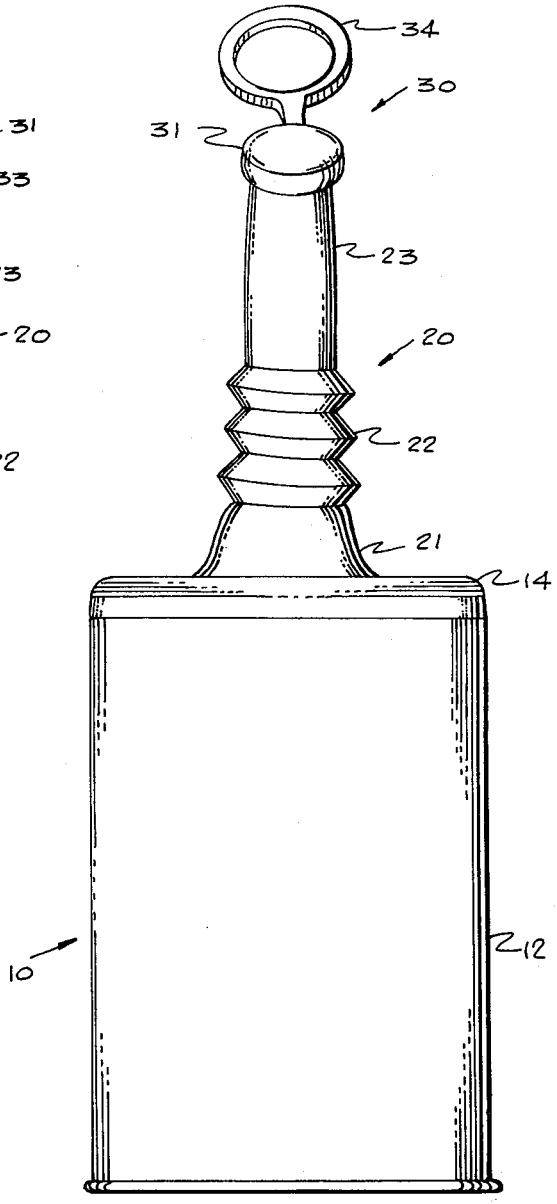
FIG. 2 is a front elevational view of a spout container as shown in FIG. 1.

In FIGS. 1 and 2, a container generally indicated as 10 is provided having a side wall 12 that is generally cylindrical in shape. A top 14 is provided that is secured to side wall 12 and preferably is of unitary construction therewith. Secured to top wall 14 is a spout generally indicated as 20 which is provided to permit dispensing of the contents from within the container. As shown in FIGS. 1 and 2, spout 20 is in an extended position preparatory to dispensing of the contents of the container. As the container is filled, the spout is presented in a nested position within the container as illustrated in phantom in FIG. 1.

Spout 20 as shown in the drawings has a radius 21 at the juncture with top 14 where an inward bend is produced during collapse of the spout into the container. A plurality of accordion pleats 22 are produced along the length of spout 20 with a tubular forward end 23 secured thereto. At the tip of the tubular forward end of spout 23 is a cover generally indicated as 30. Cover 30 as will be illustrated further hereinafter can be simply a cover member for the spout that is removed therefrom so as to permit the contents of the container to pass through the spout during pouring. Additionally, with special reference to FIGS. 7 and 8, cover 30 can be a cap that is removed from the spout 20 and thereafter may be reapplied onto the upper end 23 of spout 20 in a resealing or reclosing arrangement.

Cover 30 in its securement to spout 20 may simply be an extension thereof so as to seal the forward end of spout 20. In a preferred arrangement, a weakened tear area 33 is provided adjacent forward end 23 of spout 20 and a cap 31 that forms a part of cover 30. First weakened tear area 33 extends completely around forward end 23 of spout 20 to permit cap 31 to be more easily severed or pulled apart from spout 20. As further shown, the cover 30 may include a withdrawal means 34. Withdrawal means 34 may be secured to cover 30 and is lifted to withdraw spout 20 in a convenient fashion from its nested position in container 10. Withdrawal means 34 is preferably a tab that is secured to and extends from cap 31, and has a finger opening 35 extending therethrough. One may thus extend a finger through appropriate opening 35 of withdrawal means 34 and lift upwardly to withdraw spout 20 from its nested position within container 10.

The lower end of container 10 is provided with a bead 16 where a suitable closure is produced between body side wall 12 and a bottom lid (not shown) that is generally a metal lid. In a most preferred arrangement, container 10 as illustrated in FIGS. 1 and 2, is of unitary construction, having been produced by a blow molding process where a parison is entrapped between mold halves and an expanison fluid is introduced to the inside of the parison through a blow pin, blow needle or the like to force the pliant parison into conformity with the mold cavities and thereby produce the container of the present invention. Synthetic plastic materials are utilized in the blow molding process and polyethylene and polypropylene resins are preferred.

By virtue of the blow molding process, less areas exist at which a leak may occur. In fact, the only possible opening, absent a wall puncture, would reside around lower rim 16 at which point the closure is produced between the side wall 12 and the bottom lid. The container according to the present invention may also be filled on existing commercial packaging equipment at rates at least as high as current products. On the fill line, oil or some other material is placed in the container after which a cap or lid is applied thereto and rolled to produce a seal around rib 16.

Figure 3:
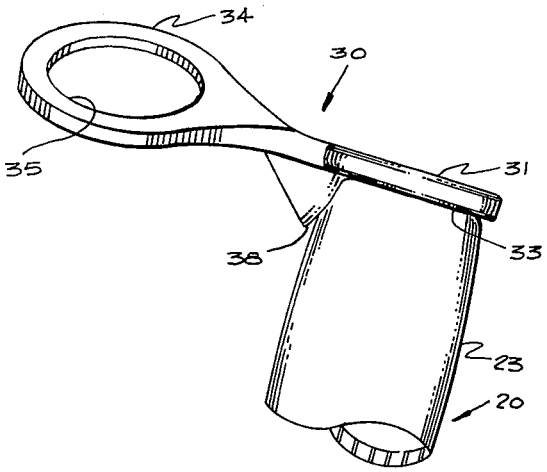
FIGS. 3–5 are partial elevational views of a spout according to the teachings of the present invention showing a vent producing means therein in various stages during spout withdrawal.
Figure 6:
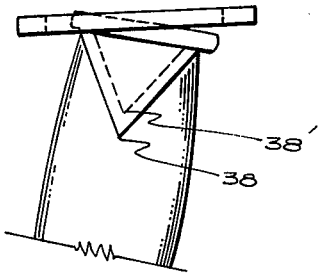
FIG. 6 is a further elevational view of the spout as shown in FIG. 3 to better illustrate the vent producing means.
Figure 4:
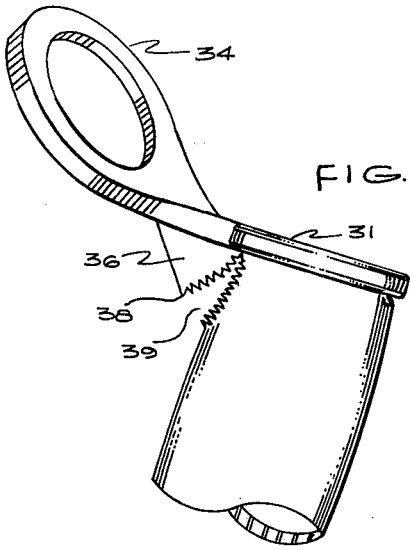

With a sealed, filled container, it becomes difficult to withdraw pouring spout 20 from its nested position within container 10. To facilitate ease of withdrawal and, in a preferred arrangement, to assist in further removal of cover 30 from spout 20, a vent is provided to defeat any forces against withdrawal. Reference is made to FIGS. 3–6 wherein specifics of a vent are disclosed and described. In FIG. 3, note that a forward end 23 of spout 20 is illustrated in a sealed arrangement. Cap 31 of cover 30 is illustrated having weakened tear area 33 located between cap 31 and forward end 23 of spout 20. A further strip of material 36 is provided, being located longitudinally along a portion of the front section 23 of spout 20 and secured to the underside of cover 30. In FIG. 6, it is noted that strip 36 which is a vent producing strip generally has a V shape with a point 38 down along spout end 23. An undercut section 38′ is provided in conjunction with vent strip 36. Undercut portion 38′ represents a second weakened tear area longitudinally along a portion of the length of spout 20. While the V shape of vent strip 36 is shown in the figures and is preferred, other shapes could be provided. It is preferred that a point similar to point 38 be provided to ensure ease of rupture to produce the vent. Upward movement of withdrawal means 34 thus causes a rupture to begin at the apex or point of undercut 38′ and to extend upwardly as shown in FIG. 4 to termination of the undercut adjacent the underside of cap 31. Rupture along the undercut 38′ thus produces a vent in spout 20 which overcomes any forces against withdrawal of spout 20 produced by a sealed arrangement and hence permits an easy removal of spout 20 from within container 10.

Figure 5:
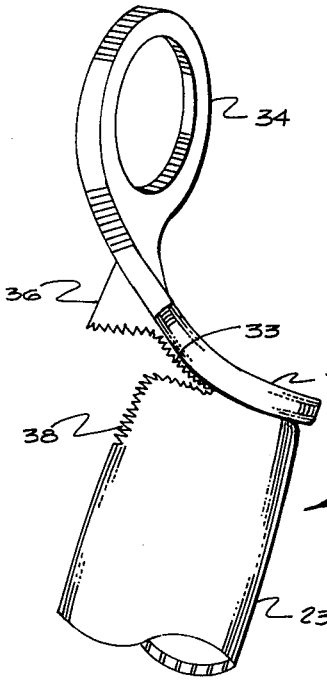

As further shown in FIG. 5, the first weakened tear area 33 located between cap 31 and upper portion 23 of spout 20 may be coincident with the termination of the second weakened tear area 38 such that at the end of production of the vent 39, a continued upward movement of withdrawal means 34 causes a reupture of the first weakened tear area 33 to separate cap 31 from sput 20 and thereafter permit dispensing of the contents of the container therethrough.

Figure 7:
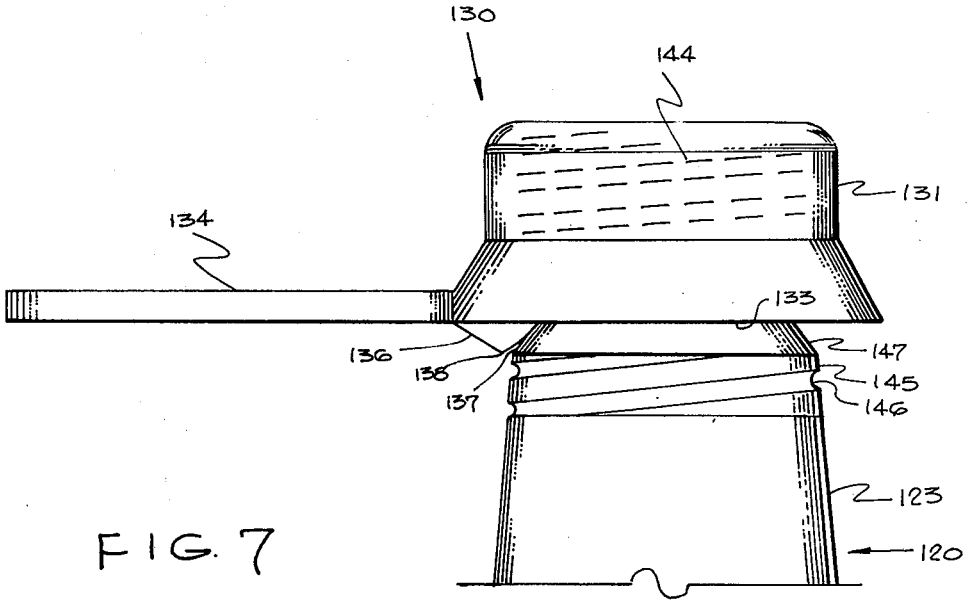
FIG. 7 is a further elevational view of a portion of a spout illustrating a recloseable arrangement for the cover and spout.
Figure 8:
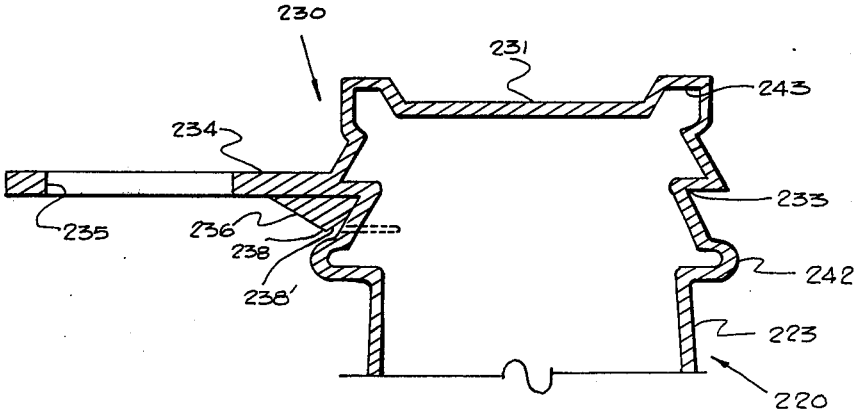
FIG. 8 is yet another partial view of a spout showing a further embodiment for a resealable arrangement between the cover and the spout.

Reference is further made to FIGS. 7 and 8 wherein exemplary reclose and reseal features of the present invention are generally described along with other vent producing embodiments. Note, for example, in FIG. 7 a threaded cap with a mating threaded portion along a forward end 123 of a spout 120. Cap 131 thus has projections 144 extending inwardly from the cap walls that will matingly fit with lands and grooves 145 and 146 respectively, along the forward end 123 of spout 120 after cap 131 has been removed and is replaced on spout 120. Adjacent weakened tear area 133, a tapered section 147 exists prior to the threaded section on spout 120. Tapered section 147 has a vent area 136 thereat. A strip of material 137 extends between vent area 136 and an underside of withdrawal tab 134. Strip 137 preferably has an undercut portion 138 adjacent vent area 136 to assist in initiation of rupture at vent area 136. As opposed to a longitudinal vent as shown in FIGS. 1–6, vent area 136 is represented by a spot type opening. With the above arrangement, as also described with respect to FIGS. 3–6, an upward movement of withdrawal means 134 will cause a rupture at vent area 136. Thereafter a separation will occur at first weakened tear area 133 between cap 131 and section 147 of spout 120. Cap 131 may thus be replaced on the forward end 123 of spout 120 and threadedly secured thereto in conventional fashion.

In FIG. 8, a snap fit reseal arrangement is shown wherein a cap 231 has an annular ring 243 received therein. Forward end 223 of spout 220 is provided with an enlarged projection 242 around a portion thereof adjacent a first weakened tear area 233 with a tapered section 247 therebetween. Likewise, a vent producing area 236 is provided on spout 220 at section 247, extending in a circumferential direction therearound. A strip of material 237 connects the underside of withdrawal means 234 to vent area 236. Vent producing area 236 likewise has an undercut 238 as was previously described earlier, whereupon, an upward movement of withdrawal 234 by engagement, for example, in finger receiving opening 235 will cause a rupture along vent area 236 in a circumferential direction. If first tear area 233 is connected to vent area 236, first weakened tear area 233 will rupture after production of vent 236 to permit removal of the cap 231 from spout 220. Thereafter, when it becomes desirable to reclose or reseal the container, cap 231 can be replaced over the upper end 223 of spout 220 such that the annular ring 243 receives enlarged section 242 in a reclosed or resealed engagement therewith.

Having described the present invention in detail, it is obvious that one skilled in the art will be able to make variations and modifications thereto without departing from the scope of the invention. Accordingly, the scope of the present invention should be determined only by the claims appeneded hereto.

What is claimed is:

1. An improved dispensing container comprising:
   a. a container body;
   b. a top secured to said body;
   c. a pouring spout secured to said top, said spout being nestable within said body and withdrawable to an extended, dispensing position;
   d. a cover secured to said pouring spout and including spout withdrawal means thereon, said cover being removeable from said spout to permit dispensing of the contents of said container therethrough; and
   e. vent forming means located on said spout and being secured to an underside of a portion of said cover, said vent forming means comprising a strip of meterial extending from beneath said cover along a portion of the length of said spout, said material having an undercut portion therealong to foster rupture upon receipt of sufficient force thereon to produce said vent in said spout and permit ease of withdrawal of said spout from a vested position.

2. An improved dispensing container as defined in claim 1 wherein said container body, top, spout and cover are of unitary construction.

3. An improved dispensing container as defined in claim 1 wherein further a first weakened tear area is located between said cover and an end of said spout, said area being tearable to remove said cover from said spout.

4. An improved dispensing container as defined in claim 3 wherein said vent producing means has a second weakened tear area associated therewith, said second weakened tear area being ruptured to produce said vent.

5. An improved dispensing container as defined in claim 1 wherein said cover is mateable with said spout after removal therefrom.

6. An improved dispensing container as defined in claim wherein said spout withdrawal means are secured to said cover and extend outwardly therefrom.

7. An improved dispensing container as defined in claim 1 wherein said strip of material tapers downwardly along said spout to an apex, and where first rupture occurs at said apex.

8. An improved dispensing container as defined in claim 1 wherein the vent is defined by a spot type opening in said spout.

9. An improved dispensing container as defined in claim 1 wherein the vent is defined by an opening in a circumferential direction partially around said spout.

10. An improved dispensing container comprising:

a. a container body;

b. a top integral with said body;

c. a pouring spout integral with said top, said spout being nestable within said body and withdrawable to an extended dispensing position;

d. a cover integral with said pouring spout, said cover having spout withdrawal means included therewith, said cover being removeable from said spout to permit dispensing of the contents of said container therethrough;

e. a weakened tear area forming a juncture between said cover and said spout and extending around said spout thereat; and f. vent forming means secured between said cover and said spout and extending along at least a portion of the length of said spout, said vent forming means being rupturable by a lifting force on said spout withdrawal means.

11. An improved dispensing container as defined in claim 10 wherein said cover has a cap portion to which the withdrawal means is secured, said cap portion being mateable with said spout after removal therefrom to reclose said container.

12. An improved dispensing container as defined in claim 11 wherein said container is resealed when said cap is replaced over said spout.

13. An improved dispensing container as defined in claim 10 wherein said vent producing means has an undercut portion therealong, rupture occuring at said undercut portion to produce said vent.

14. An improved dispensing container as defined in claim 12 where said vent producing means joins said first weakened area, whereby at the end of opening of said vent, continued pulling causes rupture of said tear area to remove said cover from said spout.

* * * * *